US006437754B2

(12) United States Patent
Yuanzhu

(10) Patent No.: US 6,437,754 B2
(45) Date of Patent: Aug. 20, 2002

(54) PRIMARY RADIATOR HAVING A SHORTER DIELECTRIC PLATE

(75) Inventor: Dou Yuanzhu, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/915,581

(22) Filed: Jul. 26, 2001

(30) Foreign Application Priority Data

Jul. 27, 2000 (JP) ..... 2000-227473

(51) Int. Cl.[7] ..... H01Q 13/00
(52) U.S. Cl. ..... 343/786; 343/772; 343/776
(58) Field of Search ..... 343/772, 776, 343/786

(56) References Cited

U.S. PATENT DOCUMENTS 3,388,399 A * 6/1968 Lewis ..... 343/783
4,041,499 A * 8/1977 Liu et al. ..... 343/756
4,502,053 A * 2/1985 Dupressoir et al. ..... 343/727
4,707,702 A * 11/1987 Withers ..... 333/21 A
4,885,556 A * 12/1989 Lamberty et al. ..... 333/208
4,896,163 A * 1/1990 Shibata et al. ..... 333/21 A
5,003,152 A * 3/1991 Matsuo et al. ..... 118/723 R
5,459,441 A * 10/1995 Weber et al. ..... 333/136

FOREIGN PATENT DOCUMENTS

JP 403243002 A * 10/1991 ..... H01Q/3/00
JP 407321540 A * 12/1995 ..... H01Q/13/02
JP 411004103 A * 1/1999 ..... H01Q/13/02
JP 2001-77621 3/2001

* cited by examiner

*Primary Examiner*—Don Wong
*Assistant Examiner*—Shih-Chao Chen
(74) *Attorney, Agent, or Firm*—Brinks Hofer Gilson & Lione

(57) ABSTRACT

In a primary radiator, a dielectric plate is fixed to the interior of a hollow first waveguide having, at one end, an opening shaped like a regular square, and is substantially orthogonal to two parallel sides of the opening. A second waveguide of rectangular cross section is coaxially connected to the other end of the first waveguide. A pair of probes are disposed at an angle of approximately 45° with respect to the dielectric plate so as to protrude from flat inner wall surfaces of the second waveguide toward the center axis.

4 Claims, 5 Drawing Sheets

PRIMARY RADIATOR HAVING A SHORTER DIELECTRIC PLATE

BACKGROUND OF THE INVENTION

1. Field of the Invention

The present invention relates to a primary radiator provided in a satellite broadcasting reflective antenna and the like, and more particularly, to a primary radiator in which a dielectric plate serving as a 90-degree phase shifter is placed inside a waveguide.

2. Description of the Related Art

FIGS. 9A and 9B are a left side view and a sectional view, respectively, showing such a type of conventional primary radiator. The conventional primary radiator comprises a waveguide 10 which is opened at one end and is closed at the other end, a dielectric plate 11 placed inside the waveguide 10, and a pair of probes 12 and 13 inserted in the waveguide 10 through outer wall surfaces thereof. The probes 12 and 13 are disposed at a distance corresponding to about one quarter the guide wavelength from the closed surface of the waveguide 10. The waveguide 10 is a rectangular waveguide having a cavity of rectangular cross section. Although not shown, a horn portion is formed at the open end of the waveguide 10 so as to receive electric waves. Such a rectangular waveguide has, for example, the advantage of reducing the area of a printed circuit board (not shown) connected to the probes 12 and 13, compared with a circular waveguide of circular cross section. The dielectric plate 11 functions as a 90-degree phase shifter, and is made of a dielectric material having a uniform thickness. The dielectric plate 11 is fixed to both diagonal corners of the waveguide 10, and both ends thereof in the longitudinal direction are cut out in a V-shape in order to improve the input impedance and output impedance. The probes 12 and 13 are orthogonal to each other, and the dielectric plate 11 is disposed at an angle of approximately 45° to the probes 12 and 13.

In the primary radiator with such a configuration, for example, in order to receive a right-handed circularly polarized wave and a left-handed circularly polarized wave transmitted from a satellite, the circularly polarized waves are guided into the waveguide 10 from the open end via the horn portion (not shown), and are converted into linearly polarized waves inside the waveguide 10 by the dielectric plate 11. That is, since a composite vector of two linearly polarized waves having the same amplitude and having a 90-degree phase difference therebetween rotates in a circularly polarized wave, when the circularly polarized wave passes through the dielectric plate 11, the phases shifted 90° are caused to become the same phase and the circularly polarized wave is converted into a linearly polarized wave. Since the left-handed circularly polarized wave is converted into a vertically polarized wave and the right-handed circularly polarized wave is converted into a horizontally polarized wave in the example shown in FIGS. 9A and 9B, by receiving the vertically polarized wave and the horizontally polarized wave after coupling the waves to the probes 12 and 13, the received signals can be subjected to frequency conversion by a converter circuit (not shown) and can be then output as IF signals.

In the primary radiator with the above-described configuration, the electric field distribution inside the waveguide 10 of rectangular cross section is shown in FIG. 10. This figure shows that an electric field E1 (shown by broken lines) and an electric field E2 (shown by solid lines) have an intensity distribution such as to spread in an arc-shaped form from the corners of the waveguide 10 and that the electric field E1 does not exist at both ends of the dielectric plate 11 fixed to the corners of the waveguide 10. This is because the electric fields E1 and E2 are directed perpendicularly to the flat surfaces of the waveguide 10, and as a result, polarized wave components propagating through the dielectric plate 11 are reduced. For this reason, in order to cause the phases shifted 90° to become the same phase by the dielectric plate 11, the dielectric plate 11 must be sufficiently long along the center axis of the waveguide 10. That is, the required length of the circularly polarized wave converting section is increased, and this inhibits the size reduction of the primary radiator.

By fixing the dielectric plate 11 perpendicularly to the opposing flat surfaces of the waveguide 10, polarized wave components propagating through the dielectric plate 11 are increased. In this case, since the probes 12 and 13 disposed at approximately 45° with respect to the dielectric plate 11 must be placed at the corners of the waveguide 10, no electric field exists around the probes 12 and 13, and this makes it impossible to couple the linearly polarized waves converted by the dielectric plate 11 to the probes 12 and 13.

SUMMARY OF THE INVENTION

The present invention has been made in view of the circumstances of the conventional art, and an object of the invention is to provide a primary radiator which is suitably reduced in size by shortening a dielectric plate serving as a 90-degree phase shifter.

In order to achieve the above object, according to an aspect of the present invention, there is provided a primary radiator including a first waveguide having a rectangular opening at one end, a dielectric plate placed inside the first waveguide so as to be substantially orthogonal to two parallel sides of the opening, a second waveguide of rectangular cross section coaxially connected to the other end of the first waveguide, and a probe protruding from an inner wall surface of the second waveguide toward the center axis, wherein the inner wall surface of the second waveguide is disposed at an angle of approximately 45° with respect to the dielectric plate.

In the primary radiator with such a configuration, the dielectric plate placed inside the first waveguide is disposed at an angle of approximately 45° with respect to the flat surface of the second waveguide and is substantially orthogonal to two parallel sides of the opening of the first waveguide. Therefore, even when the length of the dielectric plate is reduced, the phase difference with respect to orthogonal polarized waves is increased, and the size of the primary radiator can be reduced. In this case, while it is preferable that the opening of the first waveguide be shaped like a regular square, it may be shaped like a regular polygon having two opposing parallel sides, such as a regular hexagon or a regular octagon.

According to another aspect of the present invention, there is provided a primary radiator including a first waveguide having a circular opening at one end, a dielectric plate placed inside the first waveguide, a second waveguide of rectangular cross section coaxially connected to the other end of the first waveguide, and a probe protruding from an inner wall surface of the second waveguide toward the center axis, wherein the inner wall surface of the second waveguide is disposed at an angle of approximately 45° with respect to the dielectric plate.

In the primary radiator with such a configuration, the dielectric plate placed inside the first waveguide is also disposed at an angle of approximately 45° with respect to the flat surface of the second waveguide, and the phase difference with respect to orthogonal polarized waves is increased even when the length of the dielectric plate is reduced. This can reduce the size of the primary radiator.

In the above configurations, it is preferable that a corner between adjoining inner wall surfaces of the second waveguide be inscribed in the opening of the first waveguide. In this case, the first waveguide and the second waveguide connected in the axial direction can be easily produced by extending a part of a waveguide of rectangular cross section by rolling.

Further objects, features, and advantages of the present invention will become apparent from the following description of the preferred embodiments with reference to the attached drawings.

DESCRIPTION OF THE PREFERRED EMBODIMENTS

Figure 1:
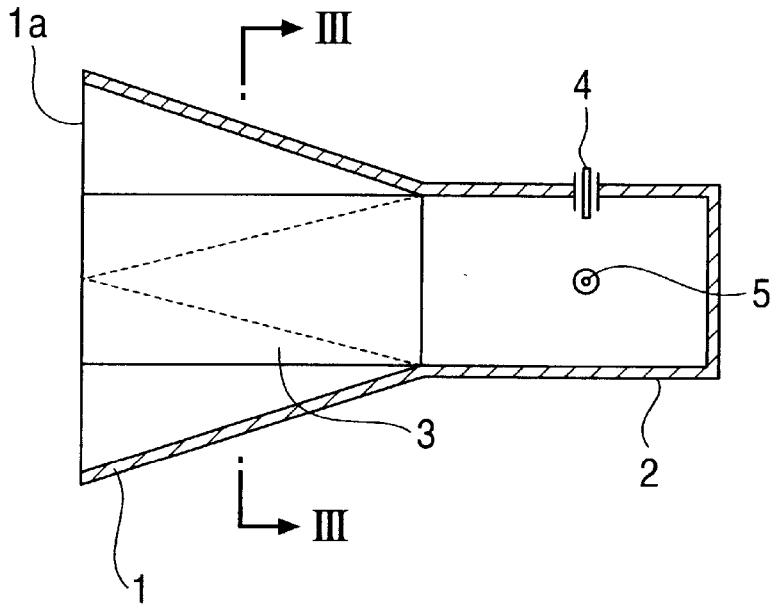
FIG. 1 is a structural view of a primary radiator according to a first embodiment of the present invention.
Figure 2:
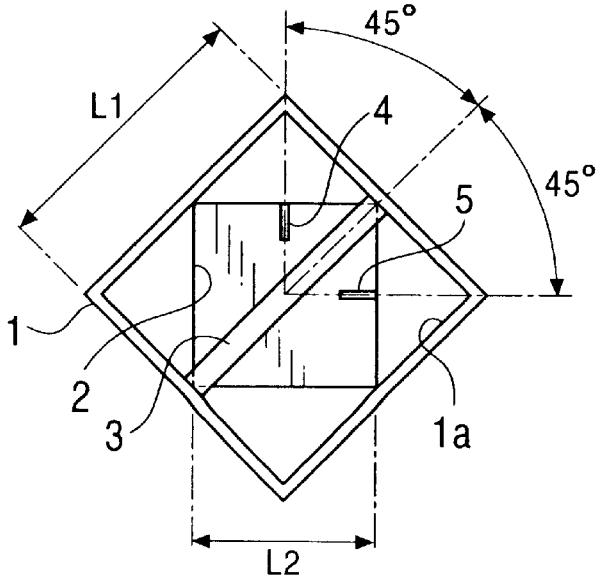
FIG. 2 is a left side view of the primary radiator.
Figure 3:
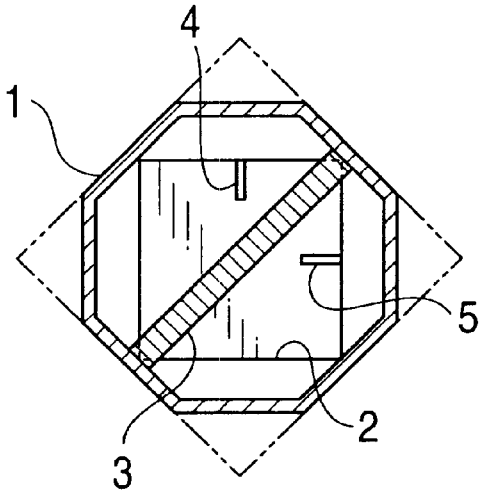
FIG. 3 is a sectional view taken along line III—III in FIG. 1.
Figure 4:
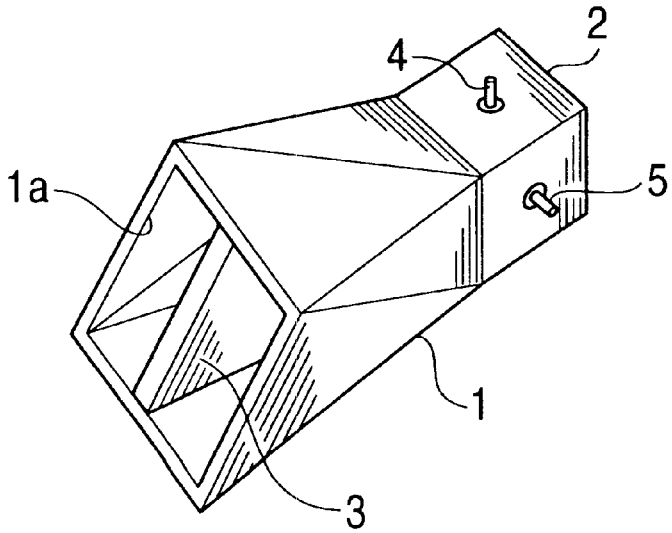
FIG. 4 is a perspective view of the primary radiator.

An embodiment of the present invention will be described below with reference to the drawings. FIG. 1 is a structural view of a primary radiator according to a first embodiment of the present invention, FIG. 2 is a left side view of the primary radiator, FIG. 3 is a sectional view taken along line III—III in FIG. 1, and FIG. 4 is a perspective view of the primary radiator.

As shown in these figures, a primary radiator of this embodiment comprises a hollow first waveguide 1 having an opening 1*a* at one end, a hollow second waveguide 2 coaxially connected to the other end of the first waveguide 1, a dielectric plate 3 placed inside the first waveguide 1, and a pair of probes 4 and 5 inserted in the second waveguide 2 through outer wall surfaces thereof. The probes 4 and 5 are disposed at a distance corresponding to about one quarter the guide wavelength from a closed surface on the right side of the second waveguide 2 in the figure.

The first waveguide 1 forms a circularly polarized wave converting section, and has a horn portion (not shown) at the opening 1*a* at the left end thereof. The opening 1*a* is shaped like a regular square, as shown in FIG. 2, whereas a middle portion of the first waveguide 1 is shaped like an octagon in cross section, as shown in FIG. 3. On the other hand, the second waveguide 2 is shaped like a regular square, and has a cavity of rectangular cross section. The sides of the opening 1*a* of the first waveguide 1 and the sides of the cavity of the second waveguide 2 are disposed at an angle of approximately 45° to each other. That is, the first waveguide 1 is shaped nearly like an octahedron composed of isosceles triangles alternately arranged in opposite orientations. One type of the isosceles triangles are placed between the sides of the opening 1*a* and the corners of the second waveguide 2, and the other type of isosceles triangles are placed between the corners of the opening 1*a* and the sides of the second waveguide 2. While the length $L_2$ of each side of the cavity of the second waveguide 2 is set to have a relation $L_2=L_1/\sqrt{2}$ with the length $L_1$ of each side of the opening 1*a* in this embodiment so that the corners of the cavity of the second waveguide 2 are inscribed in the opening 1*a* of the first waveguide 1, the size of the second waveguide 2 with respect to the opening 1*a* is not limited thereto, and may be appropriately changed as necessary.

The dielectric plate 3 is a 90-degree phase shifter made of a dielectric material such as polyethylene. The dielectric plate 3 is fixed to the interior of the first waveguide 1 so as to be substantially orthogonal to two parallel sides of the opening 1*a*. Therefore, the dielectric plate 3 is placed at an angle of approximately 45° with respect to the inner wall surfaces of the second waveguide 2, and at an angle of approximately 45° with respect to the probes 4 and 5.

In the primary radiator with such a configuration, for example, in order to receive a right-handed circularly polarized wave and a left-handed circularly polarized wave transmitted from a satellite, the circularly polarized waves are guided into the first waveguide 1 from the opening 1*a*, and are then converted into a linearly polarized wave by the dielectric plate 3 inside the first waveguide 1 serving as the circularly polarized wave converting section. The linearly polarized waves are coupled to the probes 4 and 5 inside the second waveguide 2, and signals from the probes 4 and 5 are subjected to frequency conversion by a converter circuit (not shown), and are output as IF signals, thereby receiving the circularly polarized waves transmitted from the satellite. In this case, the dielectric plate 3 is substantially orthogonal to two parallel sides of the opening 1*a* inside the first waveguide 1, and polarized wave components propagating through the dielectric plate 3 are increased. Therefore, even when the dielectric plate 3 is shortened by shortening the circularly polarized wave converting section, it is possible to cause the phases shifted 90° to become the same phase. Regarding the second waveguide 2 connected to the first waveguide 1, since the inner wall surfaces of the second waveguide 2 are disposed at an angle of approximately 45° with respect to the dielectric plate 3, the linearly polarized waves converted by the dielectric plate 3 in the circularly polarized wave converting section can be reliably coupled to the probes 4 and 5. Consequently, even when the dielectric plate 3 is shortened, the phase difference with respect to the orthogonal polarized waves is increased, and the length of the circularly polarized wave converting section can be shortened. This can reduce the size of the primary radiator.

According to the above-described primary radiator of the first embodiment, since the dielectric plate 3 placed inside the first waveguide 1 is disposed at an angle of approximately 45° with respect to the flat surfaces of the second waveguide 2 and is substantially orthogonal to the two parallel sides of the opening 1*a* of the first waveguide 1, even when the length of the dielectric plate 3 is reduced, the phase difference with respect to the orthogonal polarized waves is increased, and the size of the primary radiator can be reduced. Furthermore, since the corners between the adjacent inner wall surfaces of the second waveguide 2 are set to be inscribed in the opening 1*a* of the first waveguide

1, the first waveguide 1 and the second waveguide 2 connected in the axial direction can be easily produced by, for example, extending a part of a rectangular waveguide having the same cross section as that of the second waveguide 2 by rolling.

Figure 5:
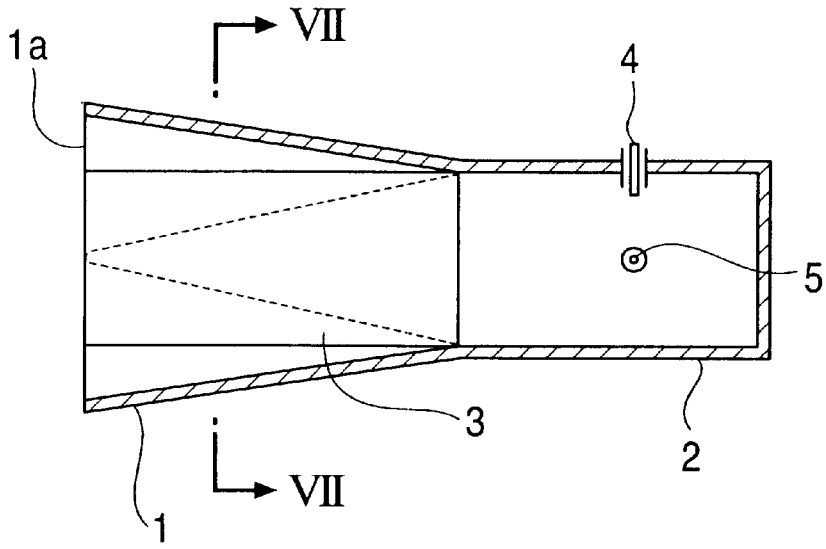
FIG. 5 is a structural view of a primary radiator according to a second embodiment of the present invention.
Figure 6:
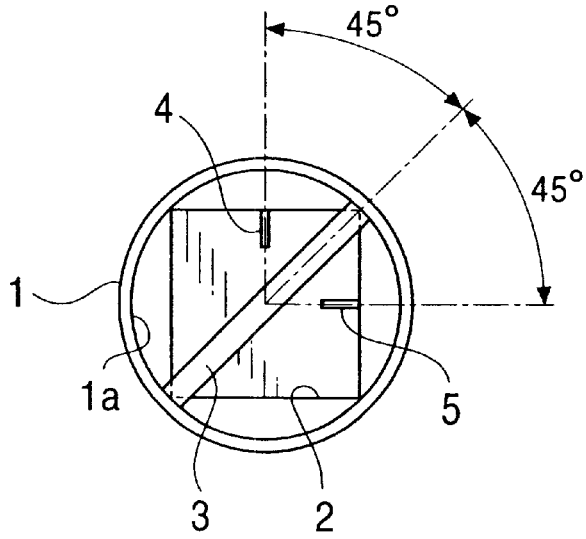
FIG. 6 is a left side view of the primary radiator.
Figure 7:
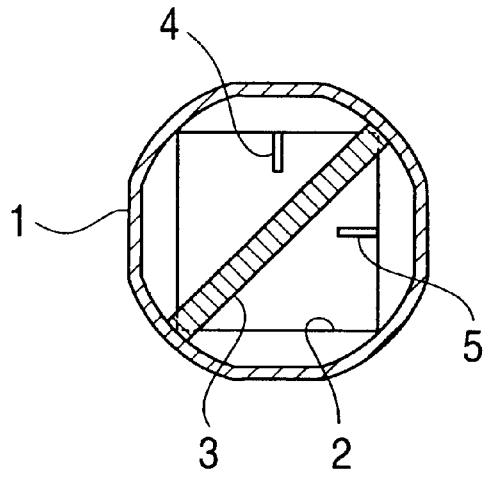
FIG. 7 is a sectional view taken along line VII—VII in FIG. 5.
Figure 8:
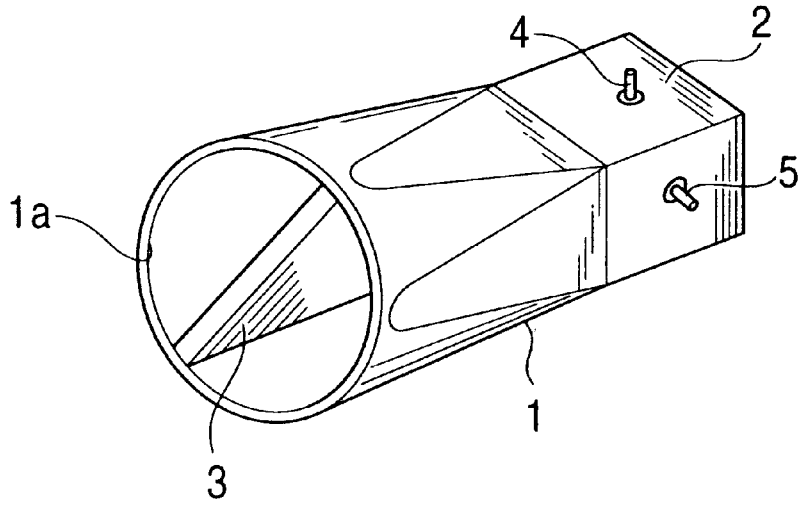
FIG. 8 is a perspective view of the primary radiator.
Figure 9A:
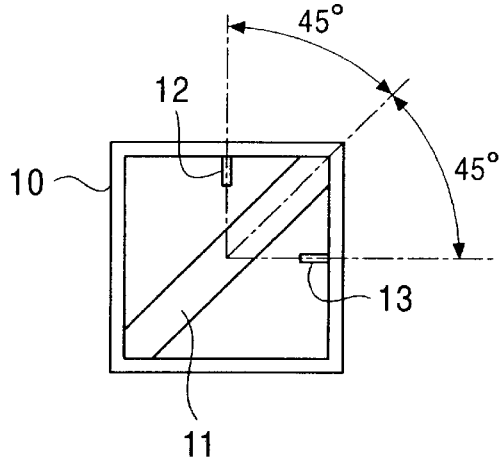
FIG. 9A PRIOR ART
FIGS. 9A and 9B are a left side and sectional view, respectively, of a conventional primary radiator.
Figure 9B:
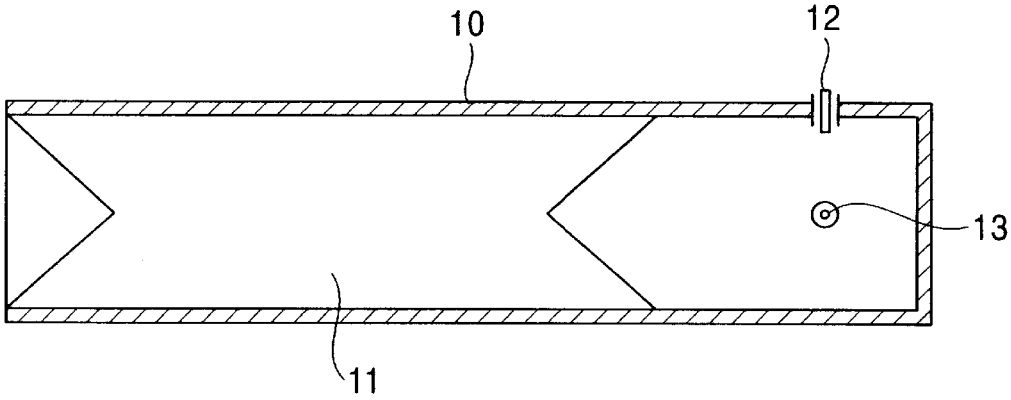
FIG. 9B PRIOR ART
Figure 10:
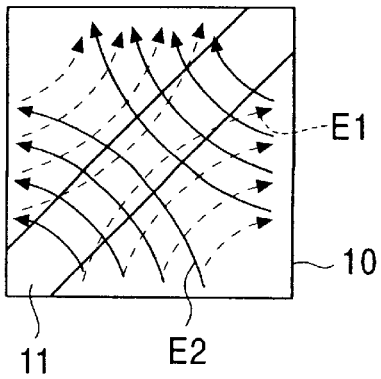
FIG. 10 PRIOR ART
FIG. 10 is an explanatory view showing a dielectric plate provided in the primary radiator and the electric field distribution.

FIG. 5 is a structural view of a primary radiator according to a second embodiment of the present invention, FIG. 6 is a left side view of the primary radiator, FIG. 7 is a sectional view taken along line VII—VII in FIG. 5, and FIG. 8 is a perspective view of the primary radiator.

This embodiment is different from the above-described first embodiment in that an opening 1*a* of a first waveguide 1 is circular, and, with this, a middle portion of the first waveguide 1 is nearly shaped like an octahedron in cross section having arc-shaped portions. Other structures are basically identical. That is, the primary radiator of the second embodiment comprises a hollow first waveguide 1 having a circular opening 1*a* at one end, a dielectric plate 3 placed inside the first waveguide 1, a second waveguide 2 coaxially connected to the other end of the first waveguide 1 and having a rectangular cross section, and a pair of probes 4 and 5 protruding from inner wall surfaces of the second waveguide 2 toward the center axis. The inner wall surfaces of the second waveguide 2 are disposed at an angle of approximately 45° with respect to the dielectric plate 3.

In the second embodiment with such a configuration, since the dielectric plate 3 is placed inside the first waveguide 1 having the circular opening 1*a,* and is disposed at an angle of approximately 45° with respect to the flat surfaces of the second waveguide 2 connected to the first waveguide 1, even when the length of the dielectric plate 3 is reduced, the phase difference with respect to orthogonal polarized waves is increased, and the size of the primary radiator can be reduced. Furthermore, since the corners between the adjoining inner wall surfaces of the second waveguide 2 are set to be inscribed in the opening 1*a* of the first waveguide 1, the first waveguide 1 and the second waveguide 2 connected in the axial direction can be easily produced by, for example, extending a part of a rectangular waveguide having the same cross section as that of the second waveguide 2 by rolling.

The present invention is carried out by the above-described embodiments, and provides the following advantages.

The waveguide is divided into the first waveguide and the second waveguide coaxially connected to each other, the opening of the first waveguide is made rectangular or circular, the dielectric plate is placed inside the first waveguide, and the inner wall surfaces of the second waveguide having a rectangular cross section are disposed at an angle of approximately 45° with respect to the dielectric plate. Since this allows the linearly polarized waves to be reliably coupled to the probes inside the second waveguide even when the polarized wave components propagating through the dielectric plate in the first waveguide are increased, it is possible to reduce the size of the primary radiator by reducing the required length of the dielectric plate.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A primary radiator comprising:

a first waveguide having a rectangular opening at one end;

a dielectric plate disposed inside said first waveguide so as to be substantially orthogonal to two parallel sides of said opening;

a second waveguide of rectangular cross section coaxially connected to the other end of said first waveguide and having a center axis; and a probe protruding from an inner wall surface of said second waveguide toward the center axis, wherein said inner wall surface of said second waveguide is disposed at an angle of approximately 45° with respect to said dielectric plate.

2. A primary radiator according to claim 1, wherein a corner between adjoining inner wall surfaces of said second waveguide is disposed so as to be inscribed in said opening.

3. A primary radiator comprising:

a first waveguide having a circular opening at one end;

a dielectric plate disposed inside said first waveguide;

a second waveguide of rectangular cross section coaxially connected to the other end of said first waveguide and having a center axis; and a probe protruding from an inner wall surface of said second waveguide toward the center axis, wherein said inner wall surface of said second waveguide is disposed at an angle of approximately 45° with respect to said dielectric plate.

4. A primary radiator according to claim 3, wherein a corner between adjoining inner wall surfaces of said second waveguide is disposed so as to be inscribed in said opening.

* * * * *